US005133469A

United States Patent [19]

Mehta et al.

[11] Patent Number: 5,133,469

[45] Date of Patent: Jul. 28, 1992

[54] STACKABLE BOTTLE

[75] Inventors: Monica R. Mehta; Ruyintan E. Mehta, both of Watchung; John S. Frazer, Long Beach Twp., Barnegat Light County; John C. Flanagan, Andover, all of N.J.

[73] Assignee: Crystal Clear Inc., Hillside, N.J.

[21] Appl. No.: 713,091

[22] Filed: Jun. 11, 1991

[51] Int. Cl.[5] ..... B65D 1/42; B65D 21/02

[52] U.S. Cl. ..... 215/10; 215/1 C; 206/509; 220/675

[58] Field of Search ..... 215/1 C, 10; 206/509; 222/185; 220/670, 672, 675; D9/370, 390, 391, 397, 411, 399

[56] References Cited

U.S. PATENT DOCUMENTS

| | | | |
|---|---|---|---|
| D. 82,398 | 10/1930 | Sharp | D9/397 X |
| 3,323,668 | 6/1967 | Hills | 215/10 |
| 4,308,955 | 1/1982 | Schieser | 215/10 X |
| 4,513,875 | 4/1985 | Kuehn, Sr. | 215/10 X |
| 4,573,595 | 3/1986 | Mednis | 206/509 X |
| 4,713,064 | 12/1987 | Bruno et al. | 215/10 X |
| 4,785,948 | 11/1988 | Strassheimer | 215/1 C |
| 4,892,207 | 1/1990 | Cullis | 215/10 X |
| 5,002,199 | 3/1991 | Frahm | 215/1 C X |

FOREIGN PATENT DOCUMENTS

| | | | |
|---|---|---|---|
| 1026864 | 4/1966 | United Kingdom | 206/509 |

*Primary Examiner*—Sue A. Weaver
*Attorney, Agent, or Firm*—John D. Kaufmann

[57] ABSTRACT

A five or six gallon blow molded plastic water bottle has a regular hexagonal cross-section. The bottle is preferably made of polycarbonate and has a wall thickness of between 0.040 and 0.060 inch. An integral protrusion is formed on one face of the bottle and a depression is formed in a second diametrically opposite face of the bottle. Adjacent bottles may be stacked by inserting the protrusion of one bottle into the depression of an adjacent bottle. With the protrusion and depression of adjacent bottles engaged, the adjacent faces of each bottle contact each other so that the weight of the upper bottle which is borne by the lower bottle is distributed across the face. When the protrusion and depression of adjacent bottles are engaged, the top surface of the protrusion does not engage the bottom surface of the depression, so that indica labels or the like attached to the depression are not defaced or damaged.

19 Claims, 3 Drawing Sheets

STACKABLE BOTTLE

BACKGROUND OF THE INVENTION

The present invention relates to an improved bottle, and, more particularly, to a large capacity molded plastic bottle of the type used to store water which is dispensed from an appropriate dispensing apparatus. The bottle of the present invention exhibits increased strength and is simultaneously more readily stackable as an aid to convenient storage.

Stackable blow-molded, large capacity plastic water bottles are known. U.S. Pat. No. 4,308,955 discloses an inter-fitting, stackable bottle made of blow-molded plastic in which water is stored for appropriate dispensing. The bottle has a rectangular cross-section taken perpendicularly to its major axis and includes a locking projection or tenon on one face thereof and a socket or mortise on an opposed face. The bottle also includes alternating ribs and indentations spaced along its major axis for strengthening the walls thereof.

To store the above prior art bottle, a first bottle is placed on a support surface or floor with its socket or mortise down and its projection or tenon pointing upwardly. A second similar bottle to be stacked on top of the first bottle is positioned so that the projection of the first bottle fits into the socket of the second bottle to horizontally locate and stabilized the stack of bottles. The weight of the superjacent bottle is carried by the engagement between the abutting surfaces or faces of the bottles.

Water bottles having circular cross-sections are also known. Typically, such bottles may be formed with similar strengthening ribs and indentations, but are typically not interlocking. Because of the around circumference of such bottles, maintaining them in a vertical stack typically requires that each bottle be held in an individual square or rectangular carton or case with the cartons or cases being vertically stacked.

The expense of fabricating and using cases for circular cross-section bottles render them somewhat inconvenient. This inconvenience was apparently one of the primary motivations for devising the rectangular cross-section bottle. Rectangular cross-section bottles may be vertically stacked, as noted above and with the projections and sockets being present a stack of such bottles is horizontally stable. Thus, the rectangular cross-section bottles exhibit an improvement relative to stackability over circular cross-section bottles and eliminate the need for cartons and cases.

Circular cross-section bottles exhibit another disadvantage. Specifically, because lateral contact of such bottles with a flat surface, or with the surface of a subjacent or superjacent bottle, results in line contact along the surface of the bottle parallel to its major axis, a high concentration of forces exists along the line when the bottles are full of water. Resting such a bottle on a surface, let alone dropping the bottle on the surface, accordingly, results in large deflections of the bottle's wall and the concomitant generation of extremely high forces and pressures within the bottle. The possibility of these high pressures and forces often results in leakage through the snap-on type of cap normally closing such bottles. These high forces and pressure may also force the snap-on cap from the bottle with a concomitant spillage of the water therein. This may result in the need to use a more leak-proof closure, such as screw-on cap. The production of such a cap and the need for the bottle neck to include a mating thread are cost-increasing factors.

Bottles with rectangular cross-sections may avoid, to some extent, the leakage and spillage problems attending the use of circular cross-section bottles closed with snap-on caps. However, although many prior art circular cross-section bottles hold about 5 gallons of water and weigh about 42.2 pounds (plus bottle weight) when filled, rectangular cross-section bottles typically hold 6 gallons and thus, weigh about 50.6 pounds (plus bottle weight) when filled. When stacked three- or four-high, the bottom rectangular cross-section bottle experiences a load of more than about 100–150 pounds. These loads have been found to result in leakage or snap-on cap dislodgement similar to that experienced with smaller capacity circular cross-section bottles. Thus, the forces and pressures within these bottle generated by wall deflection-caused contact of the bottle with a surface (or dropping of the bottle onto the surface) can force off a cap other than a screw cap or other special cap, again resulting in leakage and/or spillage.

An object of the present invention is the provision of a bottle which eliminates the disadvantages of the foregoing prior art bottles and which is convenient to use and inexpensive to manufacture.

Further objects of the present invention are the provision of a plastic, blow-molded bottle which may be sealed with a simple inexpensive snap-cap, which is stackable and which is aesthetically pleasing.

SUMMARY OF THE INVENTION

With the above and other objects in view, the present invention relates to an improved bottle for a pourable material, such as water. The bottle has a generally cylindrical body with a closed bottom portion which is generally perpendicular to the major axis of the body. The bottle also includes a generally cylindrical neck opposite the bottom. The neck is generally coaxial with the major axis of the body.

In the improved bottle, the body has hexagonal cross-section. With one of the bottle's six faces resting on a surface and a superjacent bottle having one of its six faces resting on the upper face of the lower bottle, the deflections experienced by the walls of the lower bottle are about one-half of the deflection of a rectangular bottle of similar capacity and about one-third of the deflection of a circular bottle with a similar capacity. It therefore appears that the hexagonal cross-section per se offers strength-enhancing characteristics to the bottle and, as a consequence, the bottle walls will experience smaller deflections under given loads. These smaller deflections, of course, decrease the magnitude of the forces and pressures existing within the bottle under load conditions and permit the use of a snap-on cap.

Also, according to the present invention, the bottle includes an integral protrusion on a first face of the body and a depression on the second face of the body. The first and second faces are diametrically opposed and the protrusion and the depression and complementary. A plurality of such bottles are adapted to be vertically stacked. When so stacked, the second face of the bottle is adapted to rest on a support surface so that its first face is adapted to serve as an upwardly directed support surface for the second face of a superjacent bottle. When so stacked the protrusion on the first face of the subjacent bottle is adapted to reside in the depression in the second face of the superjacent bottle to horizontally align and stabilize the stack.

In specific embodiments the protrusion includes a planar rectangular plateau which has two first sides parallel to the bottle's major axis and two second sides perpendicular to this major axis. Sloping walls connect the first sides of the plateau to the first face. The depression includes a planar rectangular base zone which is congruent with the plateau. The base zone has two first sides parallel to the bottle's major axis and two second sides perpendicular to this major axis. Sloping walls connect the second face to selected portions of the first sides of the base zone. In preferred embodiments, when the bottles are stacked, the protrusion of the lower bottle resides in the depression of the superjacent bottle with the sloping walls of the protrusion engaging the sloping walls of the depression. Further, when such engagement between the walls occurs, it is preferred that the plateau is adjacent to but out of engagement with, the base zone. In this way, indicia on, or an indicia-bearing label adhered to, the depression is not defaced or damaged by engagement with the plateau.

In other preferred embodiments, the base zone may be centrally intersected by a co-planar area which has a dimension parallel to the bottle's major axis smaller than the dimension of the first sides of the base zone, and a dimension perpendicular to the major axis which is greater than the dimension of the second side of the base zone. In this event, the sloping walls of the depression constitute two pairs of facing spaced-apart sloped regions. The weight of the superjacent bottle is born by the second face which is supported on the first face of the subjacent bottle and by the sloping walls of the protrusion on the face of the lower bottle supporting the sloped regions of the depression in the face of the superjacent bottle.

The bottle may include one or more indentations formed peripherally about its major axis and in the faces of the body for enhancing the strength of the faces. In preferred embodiments, two such indentations are formed which are spaced apart along the major axis of the body. In further preferred embodiments, the indentations are coincident with those boundaries of the protrusion and the depression which are perpendicular to the major axis.

DETAILED DESCRIPTION

Figure 1:
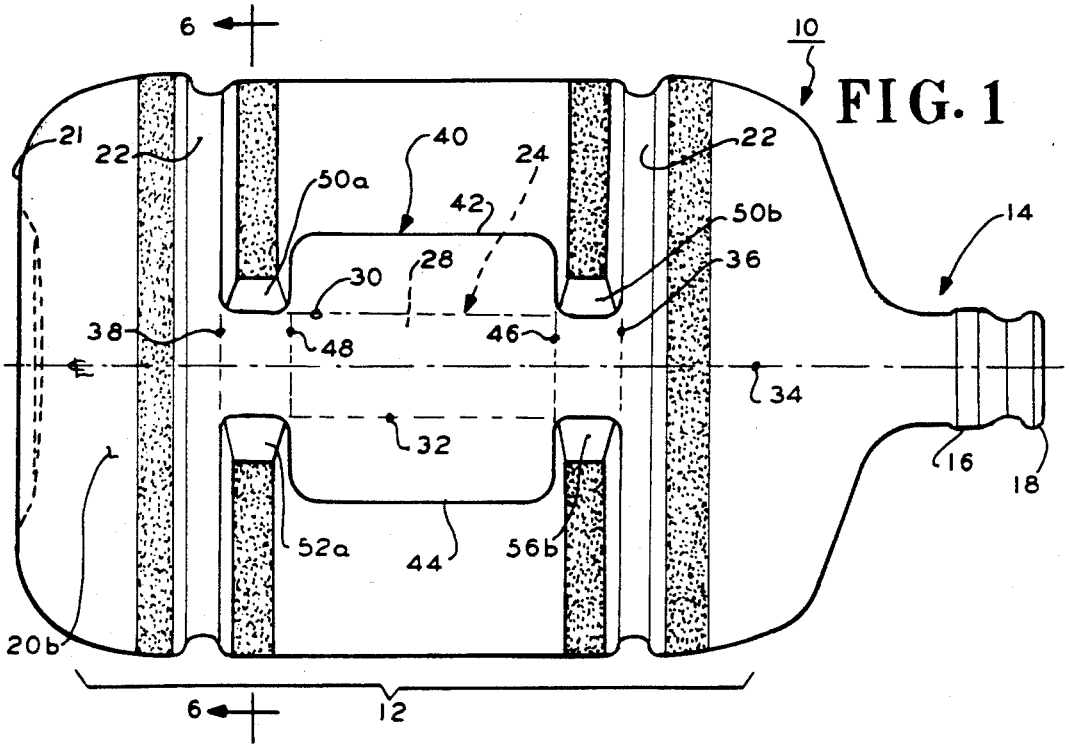
FIG. 1 is a side elevation of a bottle according to the present invention showing a portion of the bottle which is lower-most when a bottle rests on a surface.
Figure 2:
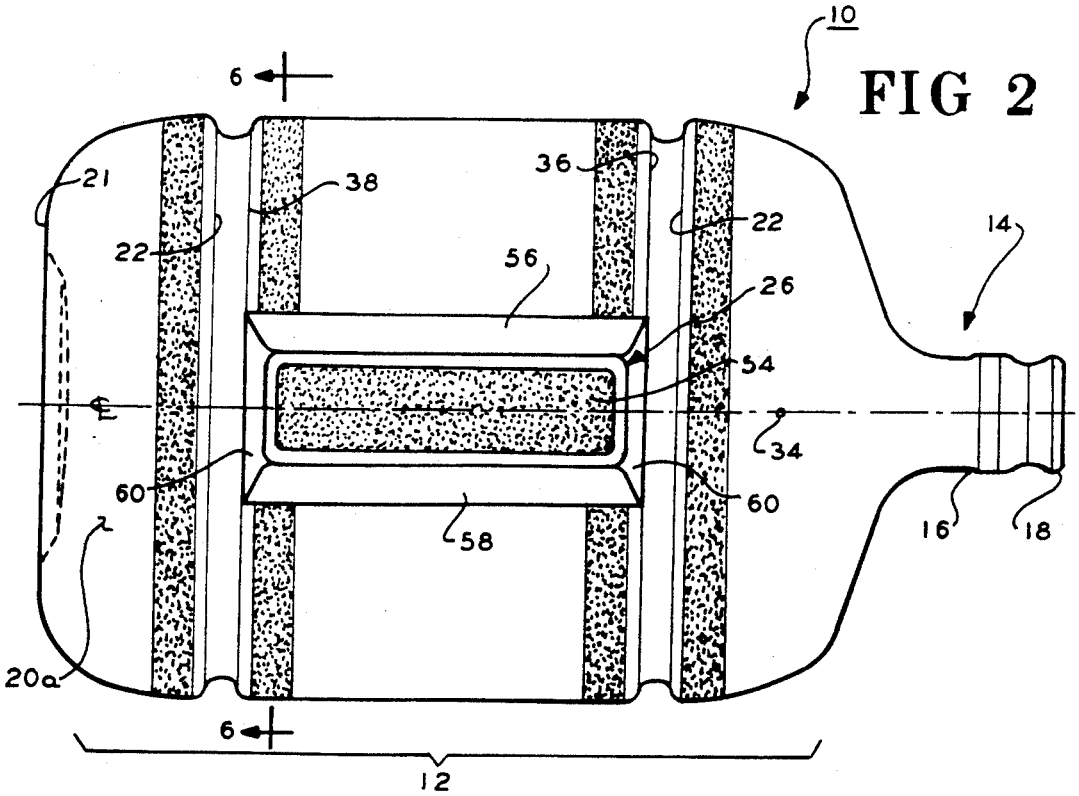
FIG. 2 is a side elevation of the bottle of FIG. 1 taken diametrically or 180° away from FIG. 1 and depicting a surface of the bottle which is uppermost when the bottle rests on a support surface.
Figure 3:
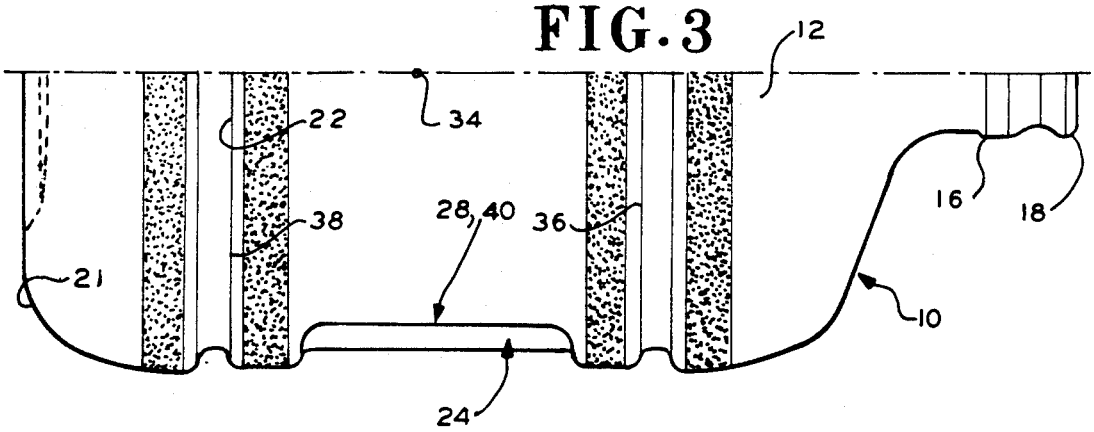
FIG. 3 is a partial side elevation of the bottle of FIG. 1.
Figure 4:
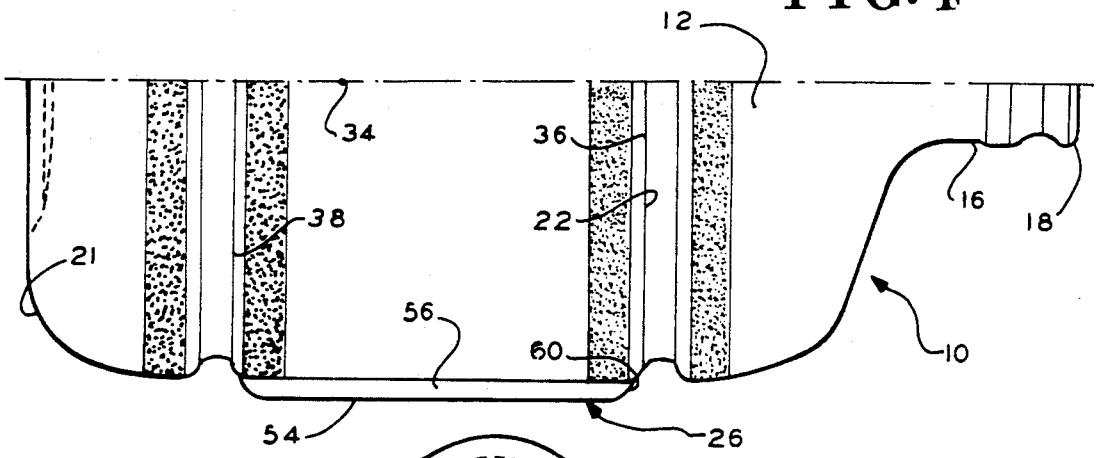
FIG. 4 is a partial side elevation of the bottle in FIG. 2.

A bottle 10, according to the present invention, is preferably blow molded from polycarbonate resin, such as materials sold under the trademark Makrolon by Mobay Corporation of Pittsburgh, Pa. and under the trademark Lexan by General Electric Plastics of Pittsfield, Mass. Typically, when used with a water dispenser, the bottle 10 holds about five gallons of water. It will be understood that bottles 10 made by other than blow-molding techniques and from materials other than polycarbonate, as well as well as bottles 10 that hold more or less than five gallons, are contemplated by the present invention.

Referring to the Figures, the bottle 10 includes a generally cylindrical body 12. Preferably, the cylindrical body 12 has generally a right circular cylindrical configuration. The bottle 10 includes an integral neck finish 14 which includes a neck 16 terminating in a pouring spout or lip 18. The neck finish 14, the neck 16 and the pouring spout or lip 18 may take any desired configuration, it being merely noted here that the neck 18 is preferably adapted to be closed with a simple snap cap (not shown) rather than a screw-on or other gripping-force-enhanced cap. Specifically as discussed in greater detail below, the bottle 10 of the present invention experiences far smaller wall deflections under given load conditions than do circular cross-section or rectangular cross-section bottles. As a consequence, forces generated internally of the bottle 10 are sufficiently lower to permit the use of the snap cap. The bottle 10 is closed opposite the neck 16 by a bottom portion generally designated 21.

Figure 5:
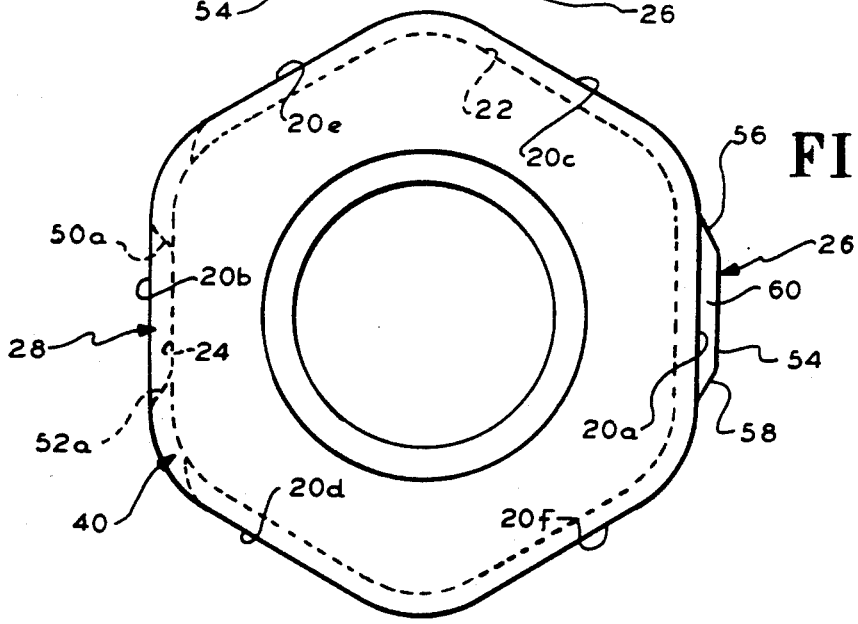
FIG. 5 is a view of the bottom of the bottle depicted in FIGS. 1–4.

As best seen in FIG. 5, the majority of the bottle 10, that is, the majority of its body 12, has a hexagonal cross section. As a consequence, there are defined on the surface of the bottle 10 six generally planar faces **20*a*–20*f*. Preferably, the hexagon of the cross section of the bottle 10 is a regular hexagon so that diametrically opposed faces 20*a*/20*b*, 20*c*/20*d*, and 20*e*/20*f* are parallel. One face, 20*b*, is intended to rest on a support surface. The support surface may, as will be seen, constitute a floor, table, pallet or other independent support surface as well as the face 20*a* of a subjacent bottle 10**.

With the face **20*b* resting on such a surface, the face 20*a* is maintained in a substantially, upwardly facing horizontal orientation to serve as a support surface for the face 20*b* of a superjacent bottle 10**.

As noted, the bottle 10 preferably holds approximately five gallons of water. In the bottled water industry, it is typical to stack water bottles four-high, that is with one bottle resting on a floor or support surface and three bottles being stacked thereabove. Three five-gallon bottles 10 filled with water weight approximately 125 pounds. Tests have been conducted comparing the hexagonal cross-section bottle 10 with bottles having the same capacity but with circular cross sections and rectangular cross sections. The three types of bottle were all made from blow-molded, polycarbonate material and all had wall thicknesses of approximately 0.060 inch. These tests showed that under 125 pounds and greater loads the hexagonal bottle 10 deflects approximately one-half as much as a bottle with a rectangular cross section and deflects approximately one-third as much as a bottle with a circular cross section. Thus, it would appear that face-to-face stacking of the hexagonal bottles 10 offers a substantial improvement over other types of bottles in that (a) stacking may be achieved without the use of cartons or crates (as with circular cross section bottles), and (b) snap-type or other low-holding force caps may be used, as contrasted with screw caps or the like as are necessitated by the greater wall deflections experienced by circular cross section and rectangular cross section bottles.

The bottle 10 may include one or more peripheral depressions 22 formed in the faces 20 thereof. Preferably two such depressions 22 are present as shown in the Figures. The depressions 22 add strength to the bottle 10 as is well known. Where the wall thickness of the bottle 10 is approximately 0.060 inch, depressions, which are approximately 0.375 inch below the surface of the faces 20 are preferred.

The face **20*b* of the bottle 10 includes a depression 24, while the face 20*a* of the bottle 10 includes a protrusion 26. The depression 24 includes a generally planar, rectangular base zone 28. The base zone 28 is defined by two boundaries, 30 and 32, which are generally parallel to the major axis 34 of the bottle 10, and two boundaries 36 and 38, which are perpendicular to the major axis 34. In the embodiment depicted, the base zone 28, is intersected by a rectangular, co-planar area 40, having boundaries 42 and 44, which are parallel to the major axis 34, and boundaries 46 and 48, which are perpendicular to the major axis 34. In effect, the co-planar area 40 enlarges the base zone 28 in directions transverse to the major axis 34. While the co-planar area 40** is not necessary to the present invention, its use is preferred as explained below.

The base zone 28 of the depression 24 is connected to the face **20*b* by sloping walls 50*a*–*b* and 52*a*–*b*. The sloping walls, 50*a*–*b* and 52*a*–*b*, are arranged in facing pairs, that is, 50*a*/52*a*, and 50*b*/52*b*. If the co-planar area 40 were absent, the walls 50*a* and 50*b* would be continuous and would extend along the entire boundary 30, and the walls 52*a* and 52*b* would be continuous and extend along the boundary 32. Preferably, the indentations 22 are coincident with the respective boundaries 36 and 38**.

The protrusion 26 includes a planar rectangular plateau 54. The plateau 54 is congruent in size with the base zone 28. The plateau 54 is connected to the face **20*a* by sloping walls 56 and 58 which extend generally parallel to the major axis 34 of the bottle 10. The plateau 54 is also connected to the base 20*a* by sidewalls 60, which may be sloped or may have other orientations. Preferably, the depressions 22 are coincident with the edges of the sidewalls 60**.

Figure 6:
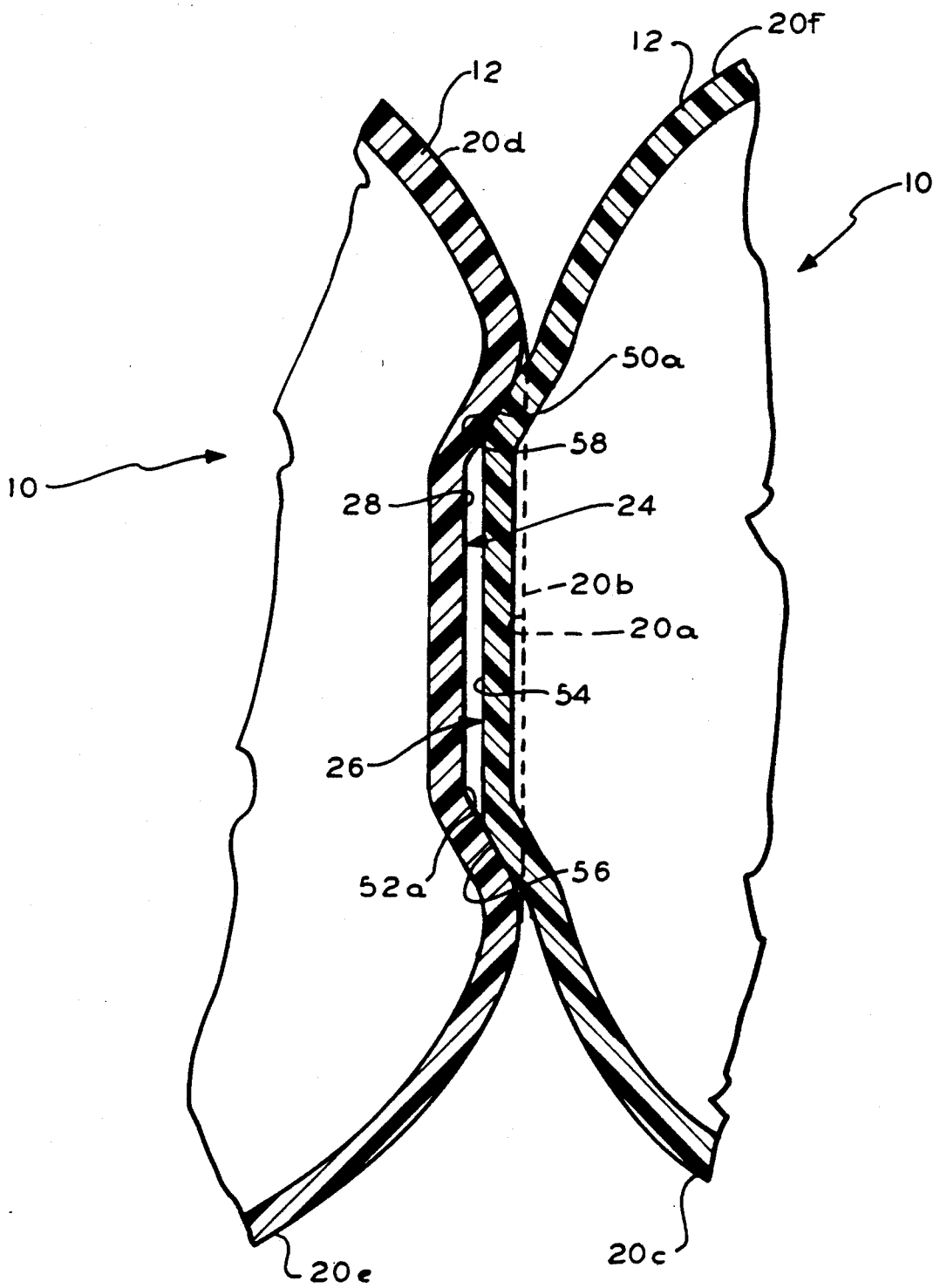
FIG. 6 is a sectional view of the area of contact between two stacked bottles of the type shown in FIGS. 1–5 which is taken generally along lines 6—6 in FIGS. 1 and 2.

As noted, the plateau 54 is generally congruent with the base zone 28. Further, the degree of slope of the walls **50*a*, 50*b*, 52*a* and 52*b* associated with the depression 24 and the sloping walls 56 and 58 is substantially the same. In this way, the protrusion 26 may conformally fit into the depression 24 when one bottle 10 is stacked on top of another bottle 10. Preferably, the depth of the depression 24 and the height of the protrusion 26, along with the degree of slope of the sloping sides 50*a*–*b* 52*a*–*b*, 56 and 58, is selected so that when bottles 10 are stacked, the plateau 54 is adjacent to, but does not engage or contact, the base zone 28 as seen in FIG. 6**.

When the bottles 10 are stacked, as described above, the cooperation between the protrusion 28 and the depression 24 helps to horizontally locate the bottles relative to each other during stacking and also serves to horizontally stabilize a stack of the bottles 10 the sloping wall **50*a*–*b*, 52*a*–*b*, 56 and 58 conveniently aid the protrusion 26 in falling into the depression 24 as a superjacent bottle 10 is moved horizontally relevant to a subjacent bottle 10. The height of the protrusion 26 and the depth of the depression 24 as well as the degree of slope of the walls 50*a*–*b*, 52*a*–*b*, 56 and 58 are also all adjusted so that, when the protrusion 26 is within the depression 24, the weight of the superjacent bottle 10 is borne by the subjacent bottle 10 via engagement between the face 20*a* of the subjacent bottle 10 and the face 20*b* of the superjacent bottle 10**.

The lack of engagement between the protrusion 54 and the base zone 28 permits indicia or an indicia-bearing label to be located on the bottle 10 within the base zone 28 without the plateau 54 engaging the label or its indicia. In this way, the label and its indicia are not defaced, damaged or obliterated or otherwise adversely affected by contact with the protrusion 26 or its plateau 54. The effect of increasing the size of the base zone 28 by its intersection with the co-planar area 40 permits more indicia, or a larger label bearing more indicia, to be used.

Tests comparing the bottle 10 of the present invention having a hexagonal cross section to bottles having circular and rectangular cross section are described above. Tests were also conducted comparing a bottle having a hexagonal cross section and a bottle having a round cross section with a hexagonal bottle having a nominal wall thickness of 0.040 inch and the circular cross section bottle having a 0.060 inch wall thickness. These tests indicated that, notwithstanding this disparity in wall thickness, the hexagonal cross section bottle 10 exhibited less deflection under loads of about 125 pounds than did the bottle having a circular cross section.

Those having skill in the art will appreciate that various changes can be made to the above-described bottle 10 without departing from the spirit and scope of the present invention.

I claim:

1. An improved bottle for a pourable material, the bottle having a generally cylindrical body with a closed bottom portion generally perpendicular to the major axis of the body and a generally cylindrical integral neck opposite the bottom and generally coaxial with the major axis of the body, wherein the improvement comprises:

the body having a regular hexagonal cross-section taken generally perpendicular to the major axis of the body, the bottle being blow molded from a plastic material, the body having a nominal thickness of between about 0.040 inch to about 0.060 inch, whereby the deflection of the body in response to a load applied thereto generally perpendicular to a major axis is about one-half of the deflection of a rectangular cross-section bottle and one-third of the deflection of a circular cross-section bottle, both being of about the same capacity, having about the same thickness and being made of the same material, with the same vertical load applied thereto.

2. A bottle as in claim 1 wherein:

the bottle is blow molded from a polycarbonate.

3. A bottle as in claim 1, which further comprises:

an integral protrusion on a first face of the body, and a depression in a second face of the body, the first and second faces being diametrically opposed and the protrusion and the depression being complementary.

4. A bottle as in claim 3, a plurality of which are adapted to be vertically stacked wherein:

the second face of the bottle is adapted to rest on a support surface to position its first face as an upwardly directed support surface for the second face of a superjacent bottle, the protrusion on the first face of the bottle being adapted to reside in the depression in the second face of the superjacent bottle to horizontally align and stabilize the stack.

5. A bottle as in claim 4, wherein:

the protrusion is a planar, rectangular plateau, having two first sides parallel to the major axis and two second sides perpendicular to the major axis and sloping walls connecting the first sides of the plateau to the first face.

6. A bottle as in claim 5, wherein:

the depression includes a planar rectangular base zone congruent with the plateau and having two first boundaries parallel to the major axis and two second boundaries perpendicular to the major axis; and sloping walls connecting the second face to selected portions of the first boundaries of the base zone.

7. A bottle as in claim 6, wherein when the protrusion of the bottle resides in the depression of a superjacent bottle, the second face of a superjacent bottle engages the first face of the bottle and the sloping walls of the protrusion on the first face of the bottle engage the sloping walls of the depression in the second face of a superjacent bottle.

8. A bottle as in claim 7, wherein:

with engagement between the sloping walls of the protrusion on the first face of the bottle and the sloping walls of the depression on the second face of a superjacent bottle, the plateau is adjacent to, but out of engagement with, the base zone.

9. A bottle as in claim 8, which further comprising:

indicia carried by the base zone, the lack of engagement between the plateau and the base zone of a superjacent bottle obviating damage to the bottle and its indicia by the plateau.

10. A bottle as in claim 6, wherein:

the base zone is centrally intersected by a co-planar area having a dimension parallel to the major axis which is smaller than the dimension of the first boundaries of the base zone, and having a dimension perpendicular to the major axis which is greater than the dimension of the second boundaries of the base zone, whereby the sloping walls of the depression constitute two pairs of facing, spaced apart, sloped regions.

11. A bottle as in claim 10, wherein:

when the protrusion of the bottle resides in the depression of a superjacent bottle, the sloping walls of the protrusion engage the sloped regions of the depression.

12. A bottle as in claim 11, wherein:

when the sloping walls of the protrusion and the sloped regions of the depression of a superjacent bottle are engaged, the plateau is adjacent to, but out of engagement with, the base zone.

13. A bottle as in claim 12 which further comprised:

indicia carried by the base zone, the lack of engagement between the plateau and the base zone of a superjacent bottle obviating damage to the indicia by the plateau.

14. A bottle as in claim 12, wherein:

the weight of a superjacent bottle is borne by the first face of the bottle supporting the second face of the superjacent bottle and by the sloping walls of the protrusion supporting the sloped regions of the depression of the superjacent bottle.

15. A bottle as in claim 4, wherein:

the protrusion includes a planar plateau, the depression includes a planar base zone congruent with the plateau, the plateau and the base zone of superjacent bottle being out of engagement when the first face of the bottle supports the second face of the superjacent bottle.

16. A bottle as in claim 15, which further comprises:

an identation formed peripherally about the major axis of the body in the faces thereof for enhancing the strength of the faces.

17. A bottle as in claim 16, wherein:

the bottle includes two indentations spaced apart along the major axis of the body.

18. A bottle as in claim 17, wherein:

the protrusion and the depression are defined by respective boundaries which are perpendicular to the major axis and respective boundaries which are parallel to the major axis.

19. A bottle as in claim 18, wherein:

the indentations are coincident with those boundaries of the protrusion and the depression which are perpendicular to the major axis.

* * * * *